US007621613B2

(12) United States Patent
Kojima

(10) Patent No.: US 7,621,613 B2
(45) Date of Patent: Nov. 24, 2009

(54) INK-JET RECORDING APPARATUS AND RECORDING METHOD FOR REALIZING SATISFACTORY RECORDING EVEN WHEN INK TEMPERATURE IS SUDDENLY CHANGED

(75) Inventor: Masatomo Kojima, Ichinomiya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 273 days.

(21) Appl. No.: 11/600,997

(22) Filed: Nov. 17, 2006

(65) Prior Publication Data

US 2007/0109344 A1 May 17, 2007

(30) Foreign Application Priority Data

Nov. 17, 2005 (JP) ..... 2005-332770

(51) Int. Cl.
*B41J 29/38* (2006.01)

(52) U.S. Cl. ..... 347/17; 347/9

(58) Field of Classification Search ..... 347/17
See application file for complete search history.

(56) References Cited

U.S. PATENT DOCUMENTS 4,860,034 A 8/1989 Watanabe et al.
5,172,142 A 12/1992 Watanabe et al.
5,838,340 A * 11/1998 Shimoda ..... 347/14
5,905,511 A 5/1999 Watanabe et al.
6,109,718 A 8/2000 Murakami et al.
6,527,355 B1 * 3/2003 Yang et al. ..... 347/14
2003/0156147 A1 * 8/2003 Misumi ..... 347/17
2006/0082605 A1 * 4/2006 Arakawa et al. ..... 347/5
2006/0146086 A1 * 7/2006 Ou et al. ..... 347/17

FOREIGN PATENT DOCUMENTS

JP 6-8049 2/1994
JP 6-278283 10/1994

* cited by examiner

*Primary Examiner*—Matthew Luu
*Assistant Examiner*—Shelby Fidler
(74) *Attorney, Agent, or Firm*—Reed Smith LLP

(57) ABSTRACT

An ink-jet recording apparatus detects a temperature of an ink-jet head, and reads, from a table of set drive voltages, a drive voltage corresponding to that head temperature. The read drive voltage is determined to be a drive voltage V1 to be used in a recording for this time. Further, when the scanning number "n" of the ink-jet head has reached a value "m", a drive voltage V2 to be used for next time is temporarily determined, based on the head temperature. When |V1−V2| is greater than a value ΔV, a voltage obtained by making a correcting, by an amount of ΔV, to the drive voltage V1 is determined to be the drive voltage V2 to be used next time. Therefore, even when the ink temperature is changed during the recording, it is possible to improve the recording quality.

15 Claims, 12 Drawing Sheets

Fig. 3

74a

| TEMPERATURE t (°C) | DRIVE VOLTAGE (V) |
|---|---|
| t<8 | 28.0 |
| 8≦t<10 | 27.5 |
| 10≦t<12 | 27.0 |
| 12≦t<14 | 26.5 |
| 14≦t<16 | 26.0 |
| 16≦t<18 | 25.5 |
| 18≦t<20 | 25.0 |
| 20≦t<22 | 24.5 |
| 22≦t<24 | 24.0 |
| 24≦t<26 | 23.5 |
| 26≦t<28 | 23.0 |
| 28≦t<30 | 22.5 |
| 30≦t<32 | 22.0 |
| 32≦t<34 | 21.5 |
| 34≦t<36 | 21.0 |
| 36≦t<38 | 20.5 |
| 38≦t<40 | 20.0 |
| 40≦t<42 | 19.5 |
| 42≦t<44 | 19.0 |
| 44≦t<46 | 18.5 |
| 46≦t | 18.0 |

Fig. 9

74b

| t=\|T1−T2\| (°C) | CORRECTION VOLTAGE ΔV (V) |
|---|---|
| 0≦t≦2 | 0 |
| 2<t≦4 | 0.5 |
| 4<t≦6 | 1.0 |
| 6<t≦8 | 1.5 |
| 8<t | 2.0 |

Fig. 10

74c

| V=\|V1−V2\| (V) | CORRECTION VOLTAGE ΔV (V) |
|---|---|
| 0≦V≦0.5 | 0 |
| 0.5<V≦1 | 0.5 |
| 1<V≦1.5 | 1.0 |
| 1.5<V≦2.0 | 1.5 |
| 2.0<V | 2.0 |

INK-JET RECORDING APPARATUS AND RECORDING METHOD FOR REALIZING SATISFACTORY RECORDING EVEN WHEN INK TEMPERATURE IS SUDDENLY CHANGED

CROSS-REFERENCE TO RELATED APPLICATION

The present application claims priority from Japanese Patent Application No. 2005-332770, filed on Nov. 17, 2005, the disclosure of which is incorporated herein by reference in its entirety.

BACKGROUND OF THE INVENTION

1. Field of the Invention

The present invention relates to an ink-jet recording apparatus which includes an ink-jet head performing a recording by discharging (jetting) an ink onto a recording-objective medium by drive of an actuator, and which determines a drive voltage of the actuator according to a temperature of the ink, and a recording method by using the ink-jet recording apparatus.

2. Description of the Related Art

As an ink-jet recording apparatus of such a type, there has hitherto known an apparatus described, for example, in Japanese Patent Application Laid-open No. 06-008049 (corresponding to U.S. Pat. Nos. 4,860,034, 5,172,142 and 5,905,511), which determines, when performing recording on a plurality of sheets of recording paper, a drive voltage according to a temperature of a head (head temperature) every time the recording is started on each of the recording papers. FIG. 8 is a graph showing a relationship, in such an ink-jet recording apparatus, between the head temperature and the drive voltage when the recording was performed at 50% recording duty. In the first recording paper, the head temperature at the start of recording is 21° C., and the drive voltage is set to 24.5 V. Further, the recording is performed at the same 24.5 V without changing the drive voltage until the recording of the first recording paper is completed. Further, for a second recording paper and a third recording paper, the recording is performed at the drive voltage of 23.0 V and 22.5 V, respectively.

On the other hand, in an ink-jet recording apparatus in which a driving IC chip (integrated circuit ship) which outputs a driving signal to an actuator is mounted on an ink-jet head, as the IC chip and the actuator generate heat due to a recording operation, the generated heat is transmitted to an ink in the ink-jet head, and there is a rise in a temperature of the ink (ink temperature). Further, as a recording density is increased, amount of heat generated by the IC chip and the actuator is increased accompanying thereto; and as the amount of generated heat is increased, the temperature of the ink also rises accompanying thereto. In such case, in order to deal with a decrease in the ink viscosity accompanying the rise in the temperature of the ink, it is necessary to lower (decrease) the drive voltage. However, in the conventional ink-jet recording apparatus as described above, even when the ink temperature is changed for a period of time during which the recording is performed on one page of the recording paper, the recording is performed at the same drive voltage. Therefore, it is not possible to perform a recording corresponding to the viscosity of ink, and thus there is a problem that recording quality is declined. In particular, in case in which an image or the like having an extremely high density of recording is recorded right away, such as performing recording of a photo data immediately after the power supply is turned ON, it is conceived that the temperature of the ink is raised suddenly, and there is a fear that the decline in the recording quality is prominent or conspicuous. Further, these days, the ink-jet printers are used all over the world and it is necessary that the ink-jet printers are adjusted to any sort of environment in which the printers are used. In particular, it is necessary that the ink-jet printers are adjusted to a sudden change in the environment in which the ink-jet printers are used when the user starts to use the printer or during the printer is being used.

SUMMARY OF THE INVENTION

In view of these situations, a first object of the present invention is to realize an ink-jet recording apparatus and a recording method which are capable of maintaining a satisfactory recording quality even when the temperature of the ink is changed during the recording of one page of recording paper. Further, a second object of the present invention is to realize an ink-jet recording apparatus and a recording method which are capable of maintaining a satisfactory recording quality even when the ink temperature is suddenly changed according to the environment in which the ink-jet recording apparatus is used and a driving situation during the recording.

According to a first aspect of the present invention, there is provided an ink-jet recording apparatus which includes an ink-jet head and performs recording by discharging an ink onto a recording-objective medium by driving an actuator, the apparatus including:

a temperature sensor which detects a temperature of the ink;

a drive voltage-determining section which determines a drive voltage for driving the actuator, according to the temperature of the ink detected by the temperature sensor, and which determines a new drive voltage when the temperature of the ink is changed; and a driving section which drives the actuator by one of the drive voltage and the new drive voltage determined by the drive voltage-determining section;

wherein the drive voltage-determining section calculates a difference one of between a first temperature detected at a first timing and a second temperature detected at a second timing and between a first drive voltage at the first timing determined based on the first temperature and a temporary drive voltage set based on the second temperature, and the drive voltage-determining section determines a second drive voltage at the second timing based on the calculated difference.

According to a second aspect of the present invention, there is provided a recording method for using an ink-jet head which performs recording by discharging an ink onto a recording-objective medium by driving an actuator, the method including:

detecting a first temperature of the ink at a first timing;

determining a first drive voltage at the first timing based on the first temperature of the ink at the first timing;

detecting a second temperature of the ink at a second timing;

setting a temporary drive voltage based on the second temperature of the ink at the second timing;

calculating a difference one of between the first temperature of the ink detected at the first timing and the second temperature of the ink detected at the second timing and between the first drive voltage at the first timing determined based on the first temperature and the temporary drive voltage set based on the second temperature;

determining a second drive voltage at the second timing based on the calculated difference; and performing the recording by discharging the ink onto the recording-objective medium by driving the actuator by the second drive voltage at the second timing which has been determined.

In these cases, one of the difference between the first temperature of the ink detected at the first timing and the second temperature of the ink detected at the second timing and the difference between the first drive voltage at the first timing which is determined based on the first temperature of the ink detected at the first timing and the temporary drive voltage set based on the second temperature of the ink detected at the second timing is calculated; and the second drive voltage at the second timing is determined based on one of the calculated differences. Therefore, even when the temperature of the ink is changed suddenly, the drive voltage does not change suddenly. Consequently, even when the temperature of the ink is changed suddenly depending on the situation in which the ink-jet head is driven or the environment in which the ink-jet head is used during the recording, it is possible to maintain a satisfactory recording quality. Further, it is possible to arbitrarily set a time interval between the first timing and the second timing, and by making this time interval shorter than a recording interval of time during which each of the pages is printed, it is possible to handle the change in the ink temperature during the recording of one page.

In the ink-jet recording apparatus and the recording method of the present invention, when the difference is not more than a predetermined value, the drive voltage-determining section may determine the temporary drive voltage to be the second drive voltage at the second timing; and when the difference is greater than the predetermined value, the drive voltage-determining section may determine a drive voltage, which is made to be close, from the first drive voltage at the first timing, to the temporary drive voltage by only a value smaller than a difference voltage between the first drive voltage at the first timing and the temporary drive voltage, to be the second drive voltage at the second timing. In these cases, even when the ink temperature is changed at the first timing and the second timing, it is possible to perform the recording by using the drive voltage according to the change in the ink temperature, thereby improving the recording quality. In other words, when there is a substantial change in the ink temperature at the first timing and the second timing, the present invention uses a drive voltage, obtained by bringing the first drive voltage at the first timing close to the temporary drive voltage, rather than using the temporary drive voltage set based on the second temperature of the ink detected at the second timing, as it is. Therefore, it is possible to prevent the drive voltage from undergoing a substantial change, and to avoid a decline in the recording quality. For example, when the drive voltage is decreased, a volume of an ink droplet which is discharged becomes smaller and a discharge speed is decreased, thereby decreasing the recording density. This in turn causes the decrease in the recording quality because when the drive voltage is suddenly decreased substantially at the first timing and the second timing, there arises a contrasting difference (shade difference) between a recording area performed at the first timing and a recording area performed at the second timing. However, according to the ink-jet recording apparatus and the recording method of the present invention, the drive voltage does not decrease substantially at the first timing and the second timing. Therefore, the contrasting difference does not occur between the recording area of the first timing and the recording area of the second timing, thereby making it possible to improve the recording quality.

In the ink-jet recording apparatus and the recording method of the present invention, the drive voltage-determining section may determine the second drive voltage at the second timing, at every first time interval, during a predetermined period of time from a start of recording; and when the predetermined period of time is elapsed, the drive voltage-determining section may determine the second drive voltage at the second timing at every second time interval which is longer than the first time interval. The ink temperature tends to increase, during the predetermined period of time from the start of recording, as the recording time is increased; and after the predetermined period of time is elapsed, the ink temperature tends to increase gradually. Consequently, rather than determining the drive voltage at a same interval irrespective of the time elapsed after the start of recording, the drive voltage is determined, at every first time interval, during the predetermined period of time after the start of recording; and after the predetermined period of time is elapsed, the drive voltage is determined at every second time interval which is longer than the first time interval, thereby making it possible to determine a drive voltage which is optimum for a change in a viscosity of ink accompanying with the increase in the ink temperature. In the ink-jet recording apparatus and the recording method of the present invention, by setting an interval for determining the drive voltage to a short time interval (first time interval) during a predetermined period of time in which the temperature of the ink rises in accordance with the increase in the recording time. Accordingly, it is possible to use the optimum drive voltage corresponding to the temperature of the ink, thereby improving the recording quality. Further, after the predetermined period of time is elapsed and during the period of time in which the rise in the temperature of ink is gradual, the interval for determining the drive voltage is set to be a longer time interval (second time interval), thereby making it possible to prevent the determination of the drive voltage from being performed unnecessarily many times. For example, as will be explained in an embodiment to be described later on, when a microcomputer executes a process for determining the drive voltage, it is possible to reduce a number of processes (steps) for determining the drive voltage. Accordingly, it is possible to reduce a load on a microcomputer.

In the ink-jet recording apparatus and the recording method of the present invention, when the difference is greater than the predetermined value, the drive voltage-determining section may determine a drive voltage, which is obtained by correcting the first drive voltage at the first timing only by a correction amount corresponding to the predetermined value, to be the second drive voltage at the second timing. For example, when a difference ($V1-V2'$) between the first drive voltage ($V1$) at the first timing and the temporary drive voltage ($v2'$) set based on the second temperature of ink detected at the second timing is a negative value, and an absolute value of the difference is greater than the predetermined value ($\Delta V$), the voltage ($V1+\Delta V$) in which the predetermined value ($\Delta V$) is added to the first drive voltage ($V1$) at the first timing may be determined to be the second drive voltage ($V2$) at the second timing. Further, when the difference ($V1-V2'$) is a positive value, and is greater than the predetermined value ($\Delta V$), the voltage ($V1-\Delta V$) in which the predetermined value ($\Delta V$) is subtracted from the first drive voltage ($V1$) at the first timing may be determined to the second drive voltage ($V2$) at the second timing. Thus, when the difference between the first drive voltage at the first timing and the temporary drive voltage ($V2'$) set at the second timing is greater than the predetermined value, rather than using the temporary drive voltage, it is possible to determine the drive voltage, which is obtained by correcting, the first drive voltage at the first timing, by the correction amount corresponding to the predetermined value, to be the second drive voltage at the second timing. Therefore, there is no fear that the recording quality is declined due to a substantial change in the drive voltage.

In the ink-jet recording apparatus and the recording method, there may be included further a table in which drive voltages are set for a plurality of temperature ranges, respectively. Further, when the difference is greater than the predetermined value, a drive voltage between the first drive voltage at the first timing and the temporary drive voltage set at the second timing may be read from the table, and the read drive voltage may be determined to be the second drive voltage at the second timing. For example, in a case provided with the table in which the drive voltages are set to decrease in accordance with the rise in the ink temperature, when a difference (V1−V2') between the first drive voltage (V1) at the first timing and the temporary drive voltage (V2') set at the second timing is a positive value, and an absolute value of the difference is greater than the predetermined value, a drive voltage closer to the first drive voltage (V1) at the first timing than the temporary drive voltage (V2') set at the second timing, namely, a drive voltage which is lower than the first drive voltage at the first timing but which is higher than the temporary drive voltage (V2') set at the second timing may be read from the table, and the read drive voltage may be determined to be the second drive voltage (V2) at the second timing. By doing so, it is possible to easily read the drive voltage which is to be set at the second timing. Further, in these cases, there is no fear that the recording quality is declined due to a substantial change in the drive voltage.

In the ink-jet recording apparatus and the recording method, the drive voltage-determining section may determine the second drive voltage at the second timing every time a scanning of the recording-objective medium is performed by the ink-jet head for a predetermined number of times. In these cases, even when a recording area having a low recording density and a recording area having a high recording density are present in one recording-objective medium in a mixed manner, it is possible to use a drive voltage optimum for the temperature of the ink which is fluctuated (changed) due to the change in the recording density, thereby making it possible to improve the recording quality.

In the ink-jet recording apparatus and the recording method, an interval between the first timing and the second timing may be shorter than a recording time for one piece of the recording-objective medium. In this case, even when the temperature of ink is changed suddenly during the recording with respect to one piece of the recording-objective medium, the drive voltage is not changed suddenly. Accordingly, it is possible to maintain a satisfactory recording quality.

In the ink-jet recording apparatus and the recording method, the temperature sensor may be provided on the ink-jet head; and the temperature of the ink may be obtained by detecting a temperature of the ink-jet head. Since the temperature of the ink inside the ink-jet head changes in accordance with a change in the temperature of the ink-jet head, it is possible to consider the temperature of the ink-jet head, detected by the temperature sensor, to be the temperature of the ink.

BRIEF DESCRIPTION OF THE DRAWINGS

FIG. 3 is a diagram explaining a Table 74*a;*

FIG. 9 is a diagram explaining a Correction Voltage Table 74*b;*

FIG. 10 is a diagram explaining a Correction Voltage Table 74*c; and*

DETAILED DESCRIPTION OF THE PREFERRED EMBODIMENTS

First Embodiment

A first embodiment of the present invention will be explained below with reference to the accompanying diagrams.

Main structure

Figure 1:
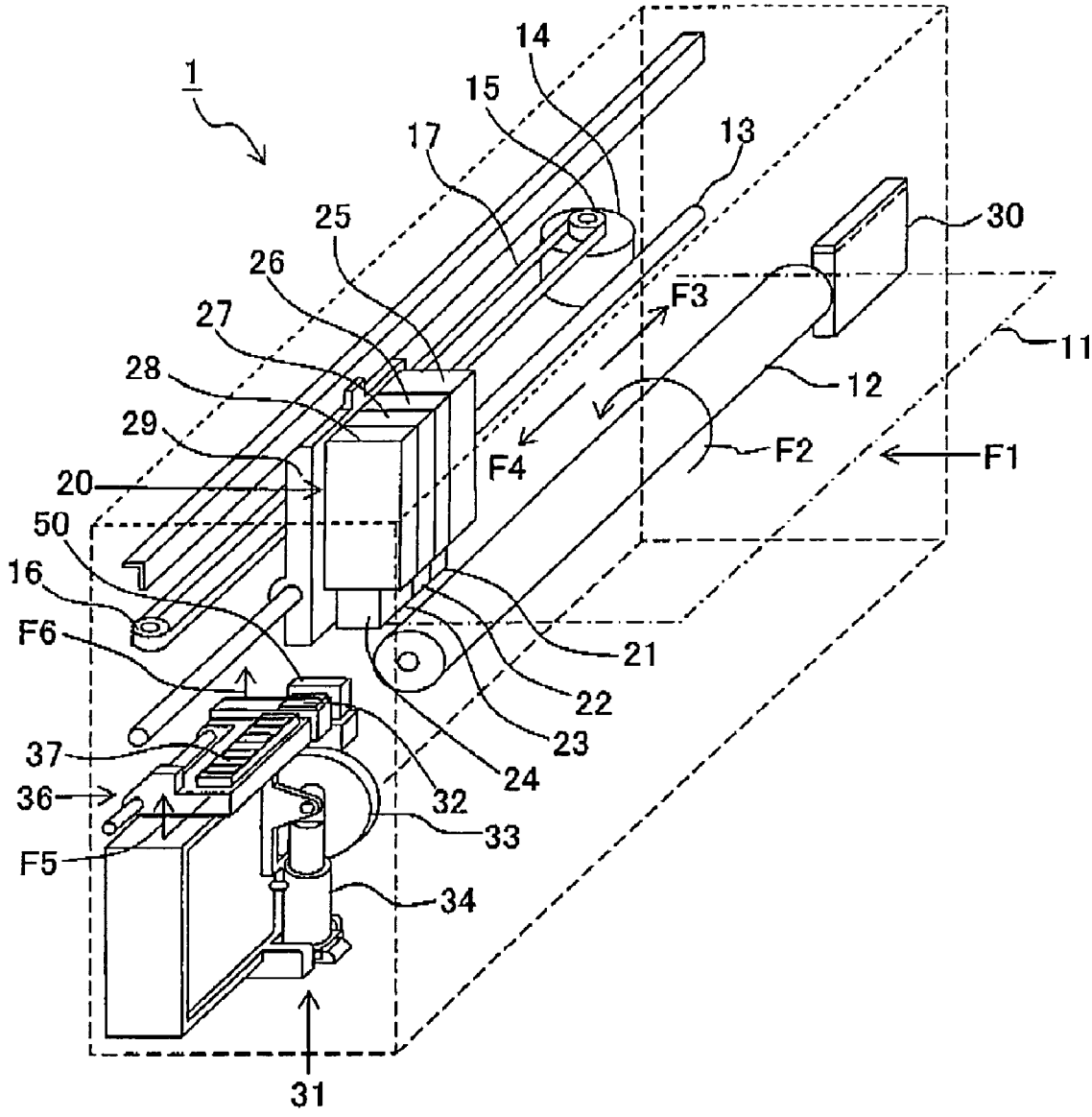
FIG. 1 is a diagram showing a main component of an ink-jet recording apparatus 1 according to a first embodiment of the present invention.

A main structure of an ink-jet recording apparatus according to the first embodiment will be explained below with reference to FIG. 1 which shows the main structure of the ink-jet recording apparatus. An ink-jet recording apparatus 1 includes a transporting roller 12 which transports or feeds a recording paper 11 (recording-objective medium) fed from a direction shown by an arrow F1 in the diagram, in a direction shown by an arrow F2. On a side of this transporting roller 12, a carriage shaft 13 is provided parallel to an axis of rotation of the transporting roller 12, and this carriage shaft 13 is inserted (passed) through a lower edge (end) of a carriage 29 on which an ink-jet head 20 is mounted-A carriage motor 14 is provided near one end of the carriage shaft 13, and a pulley 16 is provided near the other end of the carriage shaft 13. A pulley 15 is attached to a rotating shaft of the carriage motor 14, and an endless belt 17 is wound between the pulley 15 and the pulley 16.

The carriage 29 is attached to this belt 17, and the carriage 29 reciprocates along the carriage shaft 13 in directions indicated by arrows F3 and F4, when driven by the carriage motor 14. The ink-jet head 20 includes a black-ink head 21 which discharges or jets a black ink, a yellow-ink head 22 which discharges a yellow ink, a cyan-ink head 23 which discharges a cyan-ink, and a magenta-ink head 24 which discharges a magenta ink. Each of the heads 21 to 24 includes a pressure chamber which accommodates the ink, an actuator (such as a piezoelectric element) which imparts energy to the pressure chamber for discharging the ink, and a nozzle which communicate with the pressure chamber. Further, the heads 21 to 24 are provided with ink cartridges 25 to 28 respectively, which supply the inks corresponding to the respective heads. In FIG. 1, each of the heads 21 to 24 is oriented in a direction facing the recording paper 11 transported by the transporting roller 12, namely oriented or facing downward, and performs recording of an image and/or the like by discharging the ink, in a downward direction, onto the recording paper 11.

An ink absorbing pad 30 made of a porous material is provided near one end of the transporting roller 12, at a position which is outside the recording range with respect to the recording paper 11. The ink absorbing pad 30 absorbs the ink discharged from each of the heads 21 to 24 at the time when flushing is performed to recover a discharge function by discharging ink polluted with foreign matter etc. from the nozzles. A purge unit 31 is arranged near the other end of the transporting roller 12, at a position which is outside the recording range. The purge unit 31 performs purging for recovering the ink discharge function by sucking an air bubble and/or the polluted ink from the nozzle of each of the heads 21 to 24. This purge unit 31 includes a sucking cap 32 which is placed on and cover a nozzle surface in which a plurality of nozzles is arranged, a cam 33 which makes the sucking cap 32 advance in a direction indicated by an arrow F6 in the diagram, and a pump 34 which creates or generates a negative pressure inside the sucking cap 32. Further, a capping unit 36 is provided adjacent to an outer side of the sucking cap 32. The capping unit 36 prevents drying of the nozzles by covering, with a cap 37, the nozzle surface of each of the heads 21 to 24 of the ink-jet head 20 which has returned to an origin (home position). Furthermore, a wiping unit 50 is provided next to the sucking cap 32. The wiping unit 50 wipes out the ink, impurities and/or the like adhered to the nozzle surface of each of the heads 21 to 24.

Main Structure of Control System

Figure 2:
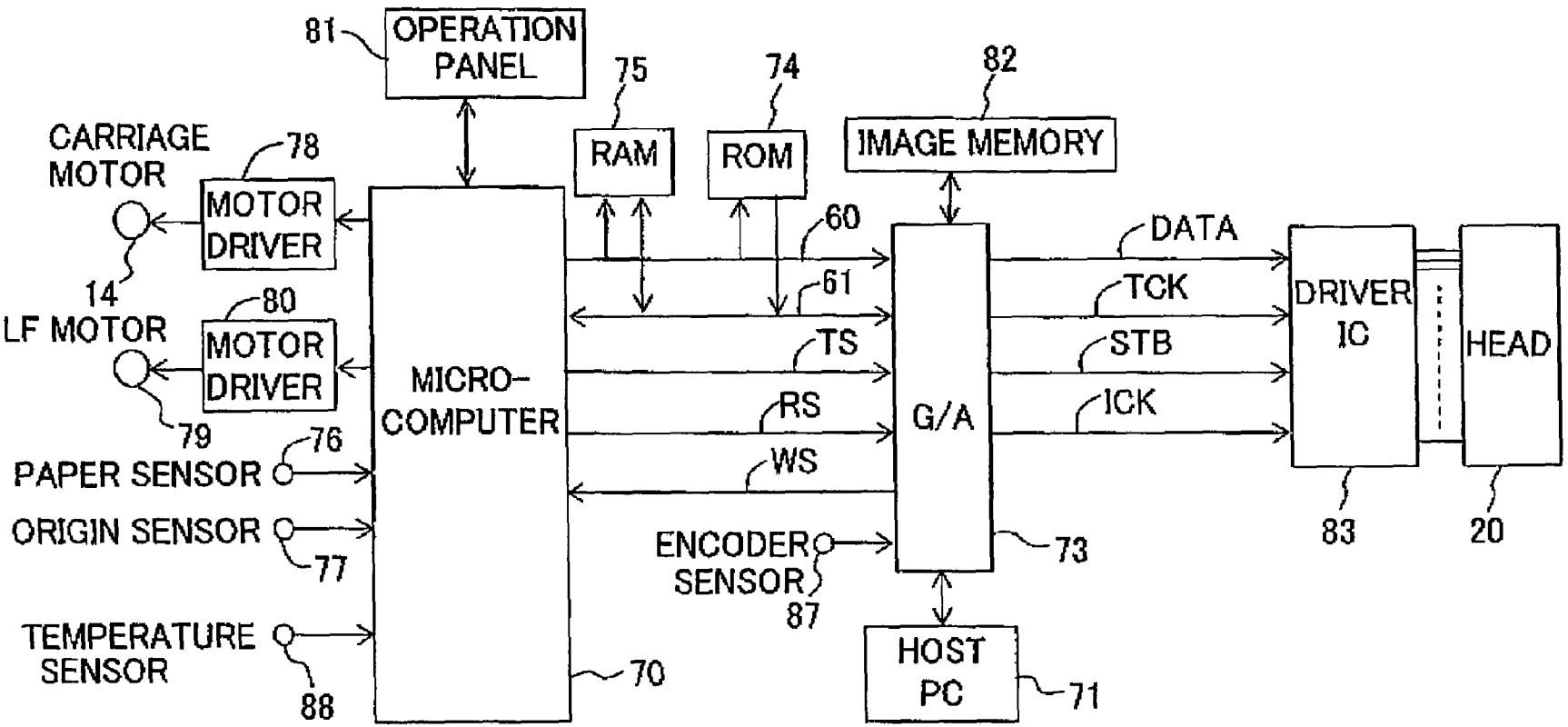
FIG. 2 is a block diagram showing a main structure of a control system of the ink-jet recording apparatus 1 shown in FIG. 1.

Next, a main structure of a control system of the ink-jet recording apparatus 1 will be explained with reference to FIG. 2 which is a block diagram showing the main structure of the control system. The ink-jet recording apparatus 1 includes a microcomputer (drive voltage-determining section) 70, a ROM (read only memory) 74, and a RAM (random access memory) 75. An operation panel 81 via which the user gives an instruction for recording and the like; a motor driver 78 which drives the carriage motor 14; a motor driver 80 which drives an LF motor (line feed motor) 79; a paper sensor 76 which detects a front end of the recording paper 11; an origin sensor 77 which detects an origin position of the carriage 29; and a temperature sensor 88 which detects a temperature of the ink-jet head 20 (hereinafter also referred to as "head temperature") are connected to the microcomputer 70.

The temperature sensor 88 is provided inside the ink-jet head 20, on an outer surface of the ink-jet head 20, or in the vicinity of the ink-jet head 20. The temperature sensor 88 detects directly the temperature of the ink-jet head 20. However, since a temperature of the ink inside the ink-jet head 20 changes corresponding to a change in the temperature of the ink-jet head 20, the temperature detected by the temperature sensor 88 can be considered to be the temperature of ink (ink temperature). A detection signal detected by the temperature sensor 88 is converted to a digital value by an A/D conversion circuit (not shown in the diagram), and the microcomputer 70 calculates the temperature of the ink-jet head 20 based on the digital value.

A Table 74*a* shown in FIG. 3 is recorded (stored) in the ROM 74. The Table 74*a* is a table which the microcomputer 70 refers to when the microcomputer 70 determines a drive voltage of the ink-jet head 20. In this Table 74*a*, different drive voltages are associated with a plurality of stages (ranges), respectively, of the head temperature. In the first embodiment, the ranges of a head temperature "t" set in the Table 74*a* is from the minimum (lowest) range of "t<8° C." to the maximum (highest) range of "46° C.≦t", and these ranges are inscribed in units of 2° C. Further, a range of the drive voltage is set from the maximum (highest) value of "28.0 V" to the minimum (lowest) value of "18.0 V". This voltage range is inscribed in units of 0.5 V, and each of the inscribed voltages corresponds to the temperature ranges, respectively, of the head. In other words, when the head temperature "t" rises by 2° C., the drive voltage is decreased by 0.5 V, and conversely, when the head temperature "t" falls by 2° C., the drive voltage is increased by 0.5 V. For example, the drive voltages corresponding to the head temperatures "t" of 23° C. and 25° C. are 24.0 V and 23.5 V, respectively.

The microcomputer 70 reads, from the Table 74*a*, the drive voltage associated with the temperature calculated, and sets the read drive voltage as a drive voltage to be used in a driver IC (driving section) 83. The ink-jet head 20 is driven by the driver IC 83, and the driver IC 83 is controlled by a gate array (G/A) 73. Electrodes forming piezoelectric elements, respectively, provided in the ink-jet head 20 are connected to the driver IC 83, and the driver IC 83, based on a control by the gate array 73, generates a driving signal appropriate for the ink-jet head 20, and applies the driving signal to each of the electrodes.

The microcomputer 70, the ROM 74 and the RAM 75 are connected to the gate array 73 via an address bus 60 and a data bus 61. The microcomputer 70 generates a recording timing signal TS and a control signal RS in accordance with a computer program stored in advance in the ROM 74, and transmits each of the signals TS and RS to the gate array 73. The gate array 73 generates, in accordance with the recording timing signal TS and the control signal RS and based on recording data stored in an image memory 82, a transfer data "DATA" which is the recording data for recording the recording data on the recording paper 11, a transfer clock TCK which is synchronized with the transfer data DATA, a strobe signal STB, and a recording clock ICK; and the gate array 73 transmits each of the DATA, the TCK, the STB, and the ICK to the driver IC 83.

Further, the gate array 73 stores recording data, transmitted from an external device such as a host computer (host PC) 71, in the image memory 82. Furthermore, the gate array 73 generates a data reception interrupt signal WS based on the data transmitted from the host computer 71 and/or the like, and transmits this data reception interrupt signal WS to the microcomputer 70. Further, an encoder sensor 87 which detects a running position (position during running) of the carriage 29 is connected to the gate array 73.

Determination of Drive Voltage

Figure 4A:
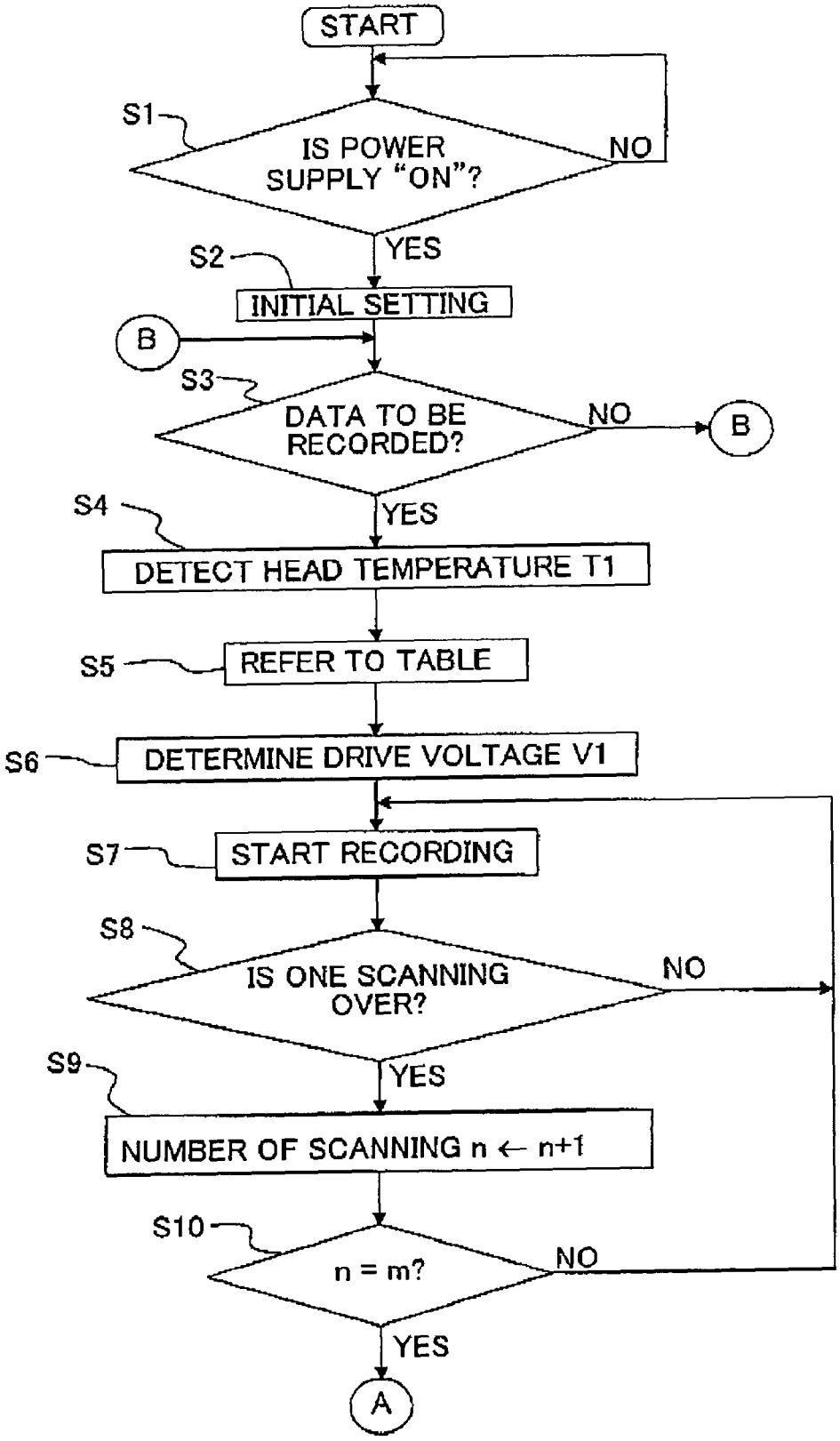
FIG. 4A is a flowchart showing a flow of a process which a microcomputer 70 performs for determining a drive voltage.
Figure 4B:
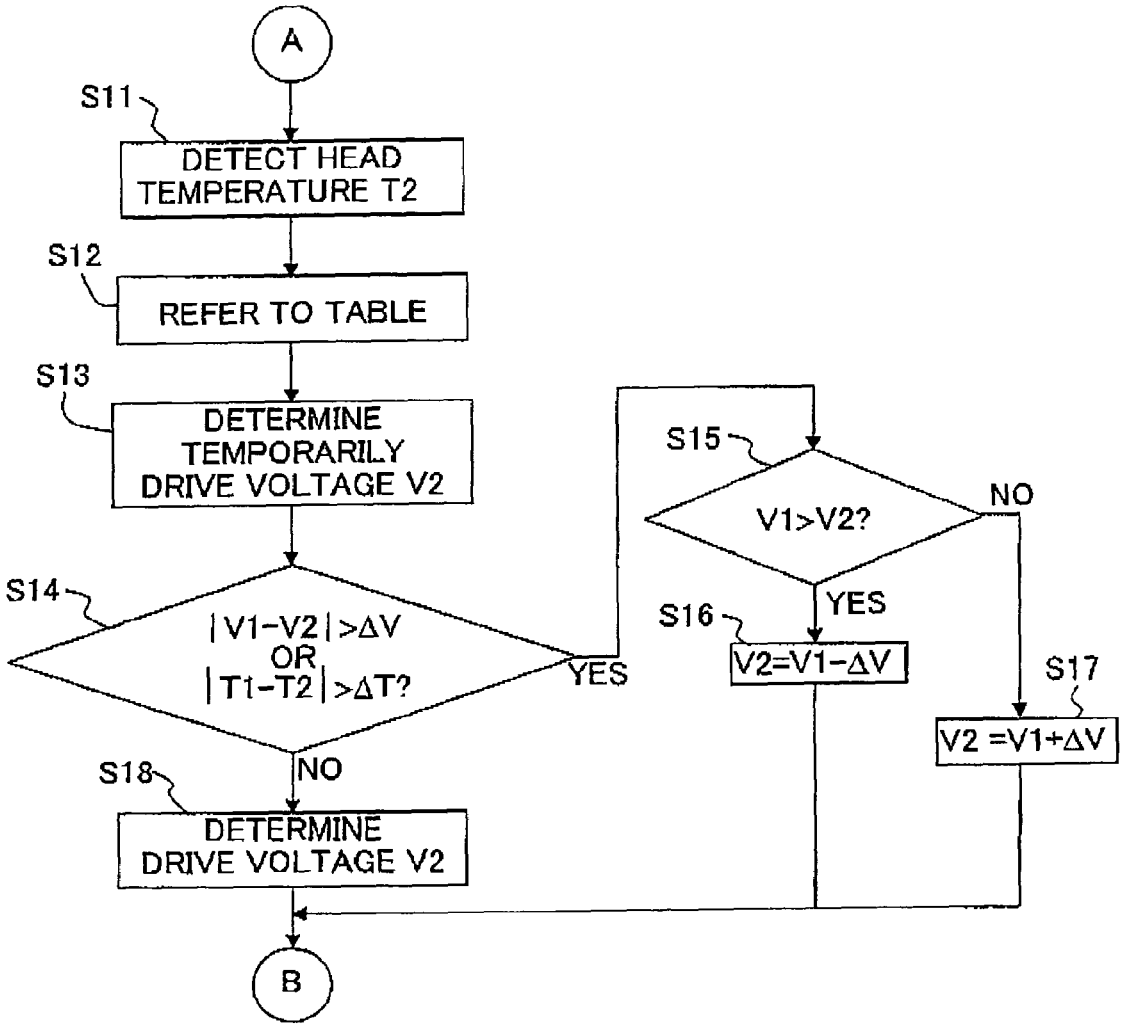
FIG. 4B is a flowchart showing the process continued from FIG. 4A.

Next, a process which the microcomputer 70 executes for determining the drive voltage will be explained below with reference to a flowchart in FIGS. 4A and 4B which show a flow of the process. The microcomputer 70 makes a judgment as to whether or not a power supply of the ink-jet recording apparatus 1 has been turned "ON" (step 1 (hereinafter abbreviated as S1)), and when it is judged that the power supply of the ink-jet recording apparatus 1 has been turned "ON" (S1: YES), the microcomputer 70 performs an initial setting (S2). Next, the microcomputer 70 makes a judgment as to whether or not recording data which is to be recorded has been stored in the image memory 82 (S3), and when it is judged that the recording data has been stored (S3: YES), the microcomputer 70 detects a head temperature T1 based on a detection signal from the temperature sensor 88 (S4), refers to the Table 74*a*

(S5), and reads, from the Table 74*a*, a drive voltage associated with the head temperature T1 detected at S4. Further, the microcomputer 70 determines the drive voltage, which has been read in S5, to be a drive voltage V1 which is to be used for performing a first recording after the power supply is turned "ON" (S6).

Next, the microcomputer 70 starts the recording at the drive voltage V1 determined at S6 (S7), and makes a judgment as to whether or not a recording equivalent to one scanning (for one scanning) is completed (S8). Here, the term "one scanning" means a movement of the ink-jet head 20, according to the recording data, from a recording-start position in a direction of width of the recording paper up to a recording-end position to perform the recording operation once. Here, when it is judged that the recording for one scanning has been completed (S8: YES), "1" is added to the number of scanning (scanning number) "n" which is a number for which the scanning has been completed (S9), and a judgment is made as to whether or not the scanning number has reached "m" (S10). Here, "m" is an arbitrary integer number, and may be a number such as 5 and 10.

Here, when it is judged that the scanning number "n" has not reached "m" (S10: No), then S7 to S9 are executed so as to continue the recording. On the other hand, when it is judged that the scanning number "n" has reached "m" (S10: Yes), then a head temperature T2 is detected (S11), the Table 74*a* is referred to (S12), a drive voltage associated with the head temperature T2 detected at S11 is read from the Table 74*a*, and the read drive voltage is determined (set) temporarily or tentatively to be a drive voltage V2 which is to he used for performing the recording this time (recording after the scanning time has reached "m") (S13). Next, an absolute value (|V1−V2|) of a difference between the drive voltage V1 determined previously at S6 and the drive voltage V2 determined temporarily this time at S13 is calculated (obtained), and a judgment is made as to whether or not the absolute value of the difference is greater than a predetermined value ΔV (S14).

Figure 5:
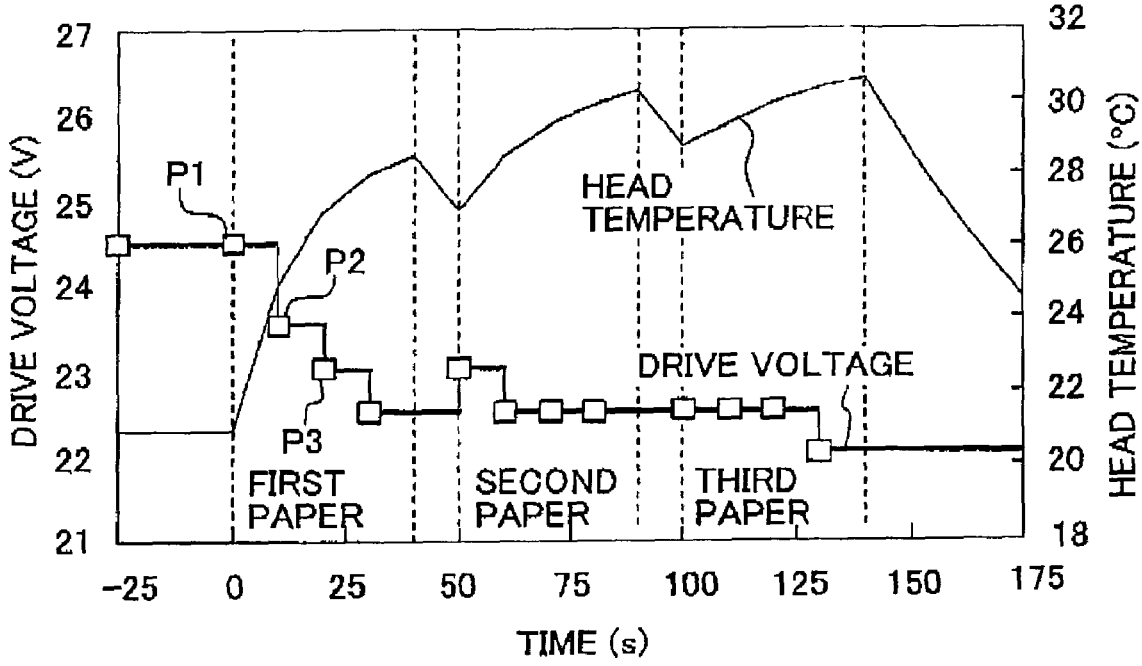
FIG. 5 is a graph showing an example of a relationship between the drive voltage and a head temperature.

Here, when it is judged that the absolute value of the difference is not greater than the predetermined value ΔV (S14: No), the drive voltage V2 determined temporarily at S13 is determined to be the drive voltage V2 for this time (S18). In other words, when the recording content is such that the head temperature does not rise during the scanning for "m" times from the start of recording and that the fluctuation in the drive voltage is small, then the drive voltage is determined by referring to the Table 74*a*. FIG. 5 is a graph showing an example of a relationship between the head temperature and the drive voltage which is determined by the abovementioned process when the recording is performed at 50% recording duty. While the recording is performed on one sheet of the recording paper, the head temperature is detected total of four times, and the drive voltage is determined at each of the detections. However, there is no sudden rise in the head temperature during each interval between the detections of the head temperature. Accordingly, at each of the timings of the head temperature detection, a drive voltage corresponding to the detected head temperature is read from the Table 74*a*, and the read drive voltage is determined to be the drive voltage V2 at each of the timings. For example, at a detection timing P1 when the recording on the first sheet of the recording paper is started, the drive voltage of 24.5 V, corresponding to the head temperature 21° C., is used. At the next detection timing P2, the drive voltage of 23.5 V, corresponding to the head temperature 25° C., is used.

Further, at step S14, when it is judged that the absolute value of the difference is greater than the predetermined value ΔV (S14: Yes), a judgment is made as to whether or not the drive voltage V1 of previous time (first timing) is greater than the drive voltage V2 of this time (second timing) (S15), and when it is judged that the drive voltage V1 is greater than the drive voltage V2 (S15: Yes), a drive voltage, with a value obtained by subtracting the predetermined value ΔV from the drive voltage V1 determined the previous time, is determined to be the drive voltage V2 for this time (S16). Further, in S15, when it is judged that the drive voltage V1 is smaller than the drive voltage V2 for this time (S15: No), a drive voltage, with a value obtained by adding the predetermined value ΔV to the drive voltage V1 determined the previous time, is determined to be the drive voltage V2 for this time (S17). In other words, when the absolute value of the difference between the drive voltage V1 determined previous time and the drive voltage V2 determined this time is greater than the predetermined voltage ΔV, a drive voltage which is made to be close (approximated), from the drive voltage V1 determined previous time, to the drive voltage V2 determined this time, by only a predetermined value ΔV having a value smaller than the absolute value of the above-described difference, is determined to be the drive voltage V2 to be used this time.

For example, a following case is assumed in which a photograph or picture is to be recorded immediately after the power supply of the ink-jet recording apparatus 1 is turned "ON"; and that the head temperature at the time of recording start is 21° C., and the drive voltage V1 is 24.5 V. Further, in this case, it is assumed that the recording of the photograph is continued even when the head temperature is detected at a subsequent detection timing; and that the head temperature detected at the subsequent detection timing had reached 35° C., and the predetermined value ΔV is set to 2.0 V. At this time, since the drive voltage associated with the head temperature 35° C. is 21.0 V in the Table 74*a*, the absolute value of difference between the drive voltage V1 determined previous time and the drive voltage V2 determined this time becomes 24.5 V −21.0 V=3.5 V, and the difference 3.5 V is greater than the predetermined value 2.0 V (3.5 V>2.0 V). Therefore, a drive voltage of 22.5 V, which is a value obtained by subtracting the predetermined value 2.0 V from 24.5 V which is the drive voltage V1 for the previous time, is determined to be the drive voltage V2 for this time.

In other words, rather than determining the drive voltage V2 this time to be 21.0 V which is smaller by 3.5 V than 24.5 V which is the drive voltage V1 of the previous time, but the drive voltage V2 for this time is determined to be 22.5 V which is smaller, by only the predetermined value of 2.0 V, than the drive voltage V1 of 24.5 V of the previous time. Next, when it is assumed that the head temperature at a further subsequent detection timing is 36.0° C., drive voltage 20.5 V, associated with the head temperature of 36° C. in the Table 74*a*, is determined temporarily to be the drive voltage V2 for this time. Since the drive voltage V1 of the previous time was 22.5 V, the absolute value of the difference between the drive voltage V1 previous time and the drive voltage V2 this time becomes 22.5 V−20.5 V=2.0 V, and since this absolute value of the difference is not greater than the predetermined value 2.0 V, the drive voltage V2 of 20.5 V which is determined temporarily this time is determined as it is to be the drive voltage V2 for this time.

Thus, in a case that the ink temperature rises suddenly during the recording during the interval in the detection of the head temperature, and that the drive voltage read from the Table 74*a* is used as it is as the drive voltage this time, then, if there is a substantial fluctuation (change) from the drive voltage of the previous time, a drive voltage obtained by making a correction, with the predetermined value, to the drive voltage used previous time is used as the drive voltage this time so as to suppress the fluctuation (change) in the drive voltage. Consequently, there is no fear that, due to a substantial fluctuation (change) in the drive voltage during recording, the discharge characteristics of ink are changed substantially and that the recording quality is declined. Further, the head temperature is detected every time the scanning number "n" has reached an arbitrary integer number "m", and by setting "m" to be a value smaller than the scanning number required for performing the recording onto one page of the recording paper, it is possible to handle the change in the temperature of ink during the recording of one page.

For example, it is necessary to lower the drive voltage in order to handle or cope with a decrease in viscosity of the ink accompanying with the rise in temperature of the ink. However, when the drive voltage is lowered suddenly, there arises a substantial difference in a density between a recording area in which the recording was performed before the change of the drive voltage and a recording area in which the recording was performed after the change of the drive voltage. Therefore, a boundary between the recording areas becomes conspicuous. However, in the ink-jet recording apparatus 1 of the first embodiment, it is possible to prevent the drive voltage from being changed substantially, by making a correction, with the predetermined value, to the drive voltage used previous time. Therefore, there is no fear that the boundary between the recording areas becomes conspicuous.

Table 74*a* is formed such that when the head temperature is changed by 2° C., the drive voltage changes by 0.5 V. Therefore, when the change in the head temperature during an interval between the detections of head temperature is greater than 8° C., the absolute value of the difference in the drive voltages becomes greater than the predetermined value of 2.0 V. Consequently, in S14 described above, when the change in the head temperature during the interval between the detections of head temperature is greater than 8° C., in other words, when an absolute value |T1−T2| of a difference between the head temperature T1 detected in S4 and the head temperature T2 detected in S11 is greater than 8° C., then a correction may be made to the drive voltage V2 of this time by executing the abovementioned steps S15 to S17. Further, when the absolute value |T1−T2| of the difference in the head temperatures is not more than 8° C., the drive voltage corresponding to the detected head temperature may be read from the Table 74*a*, and the read drive voltage may be determined to be the drive voltage V2 of this time. In other words, the difference between the head temperature (temperature of ink) detected previous time (first timing) and the head temperature (temperature of ink) detected this time (second timing) maybe obtained ( calculated) and the drive voltage of this time may be determined based on the difference.

Further, stages (ranges) of the head temperature set in the Table 74*a* are not limited to be inscribed in units of 2° C., and may be inscribed at units of 0.5° C., 1° C., and 2.5° C., or even may be inscribed at units of not less than 3° C.; and the setting of the drive voltage can also be inscribed at units of 0.125 V, 0.25 V, 0.625 V, or even not less than 0.75 V, corresponding to the stages of the head temperature. Furthermore, it is also allowable to change the predetermined value ΔV according to the stages (ranges) of the drive voltage set in the Table 74*a*.

As it has been mentioned above, when the ink-jet recording apparatus 1 of the first embodiment is used, the head temperature is detected every time the recording is performed, by scanning the ink-jet head 20 for "m" times, and it is possible to switch the drive voltage based on the head temperature detected. Therefore, it is possible to perform the recording by using an optimum drive voltage corresponding to the change in the viscosity of ink accompanying with the change in the head temperature, thereby improving the recording quality. For example, even when a recording area of low recording density and a recording area of high recording density are present in one sheet of the recording paper 11 in a mixed manner, it is possible to use a drive voltage which is optimum for the temperature of the ink fluctuated by the change in the recording density, thereby improving the recording quality.

In addition, when the difference between the drive voltage V1 determined previous time and the drive voltage V2 determined temporarily this time is greater than the predetermined value ΔV, it is possible to use a voltage which is obtained by making the correction, by only ΔV, to the drive voltage determined previous time, as the drive voltage V2 of this time. In other words, when the ink temperature is substantially changed from the previous time to this time, instead of using the drive voltage V2, determined temporarily based on the temperature of ink detected for this time as it is, a drive voltage obtained by making the correction, by only ΔV, to the drive voltage V1 determined previous time is used, thereby making it possible to avoid a decline in the recording quality which would have caused due to the substantial change in the drive voltage.

Second Embodiment

Figure 6:
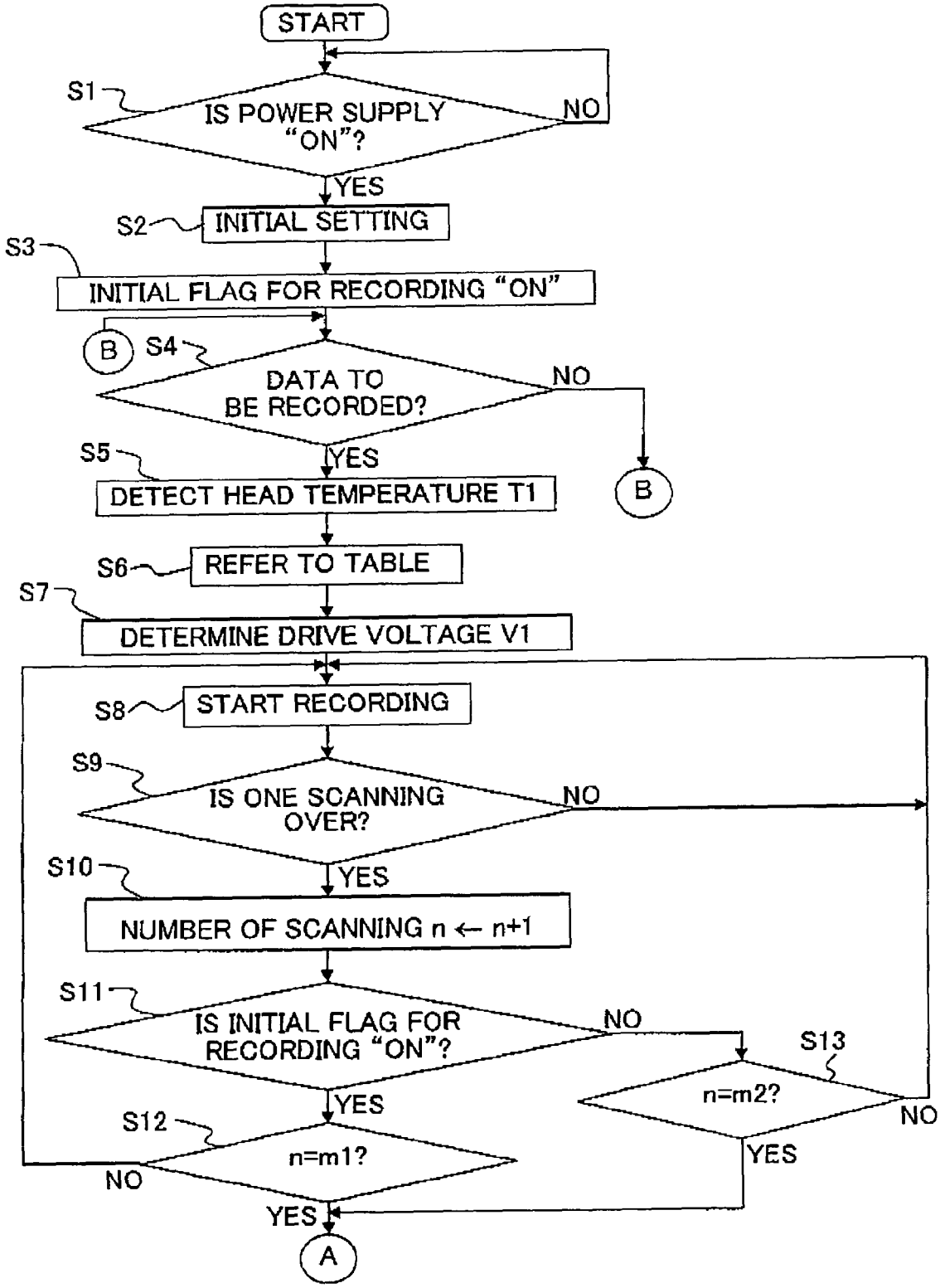
FIG. 6 is a flowchart showing a flow of a process which the microcomputer 70 performs for determining the drive voltage in a second embodiment.
Figure 7:
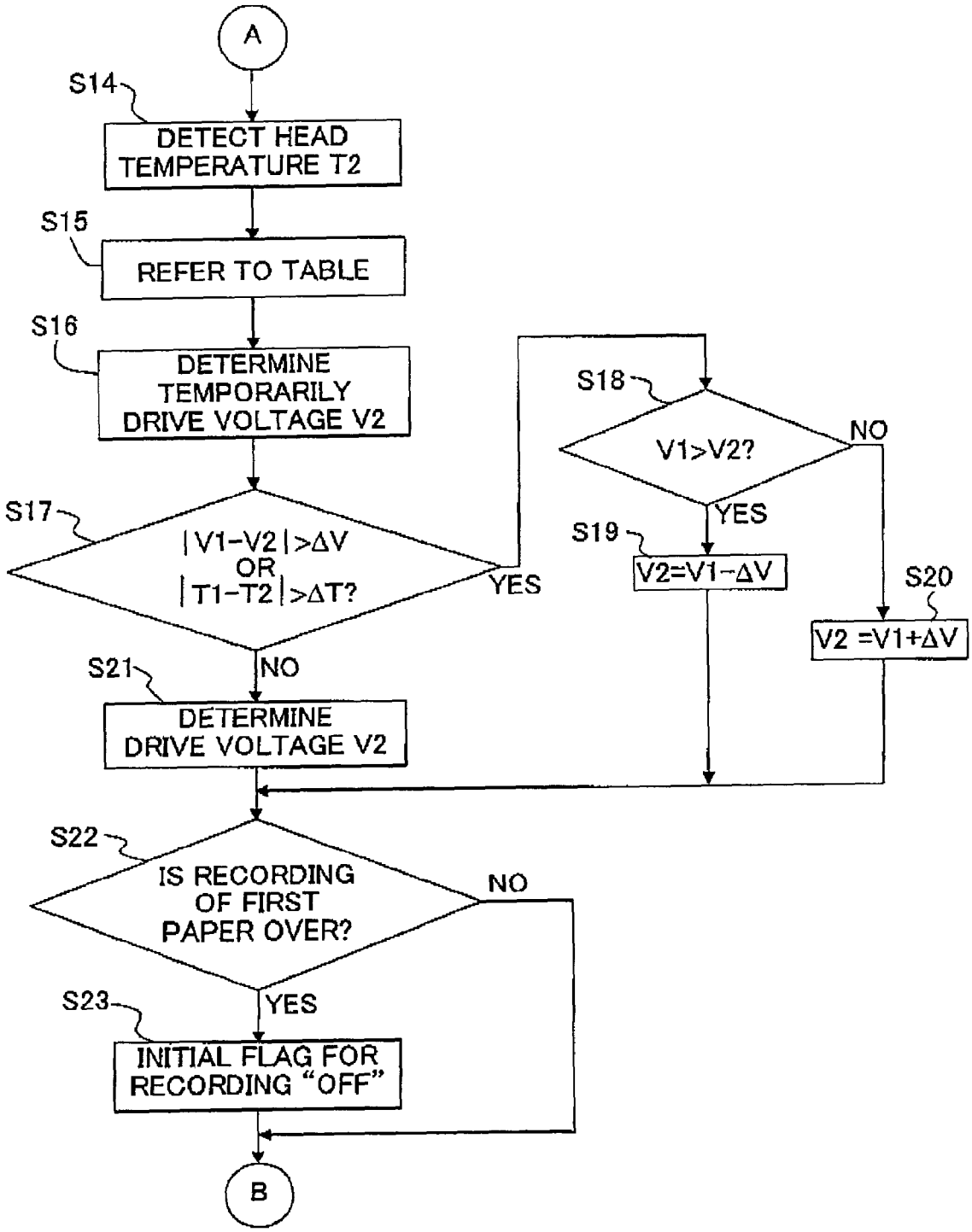
FIG. 7 is a flowchart showing the process continued from FIG. 6.
Figure 8:
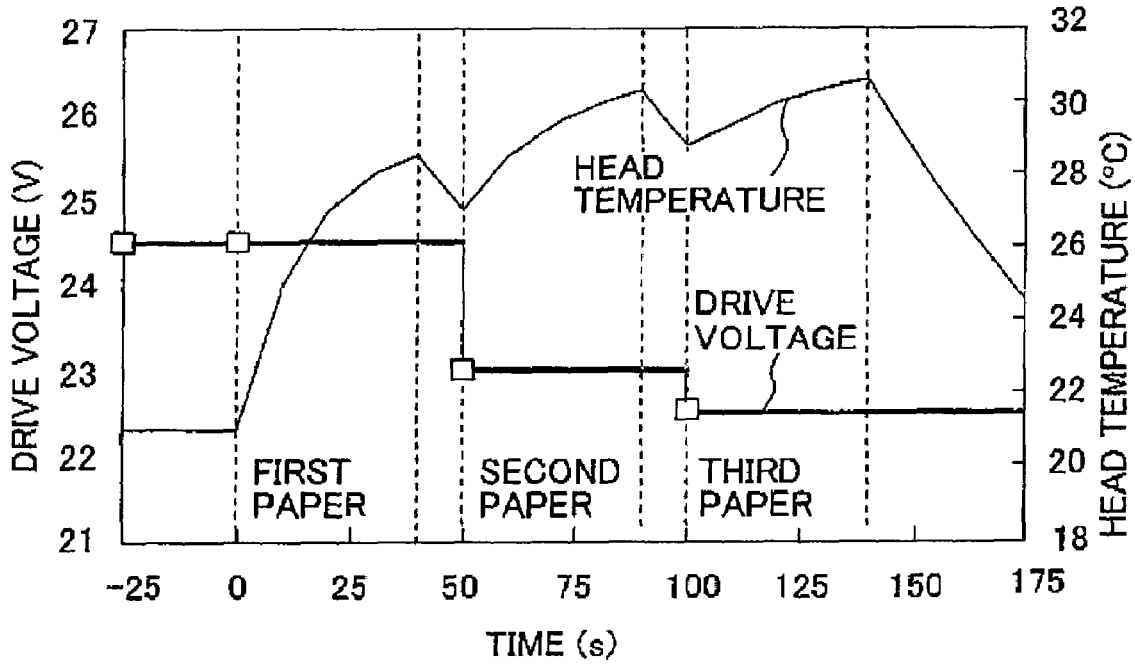
FIG. 8 is a graph showing a relationship between the head temperature and the drive voltage in a conventional ink-jet recording apparatus.

Next, a second embodiment of the present invention will be explained with reference to the accompanying diagrams. FIG. 6 is a flowchart showing a flow of a process for determining the drive voltage executed by a microcomputer provided in an ink-jet recording apparatus of the second embodiment, and FIG. 7 is the continuation of the process flowchart shown in FIG. 6. The feature of an ink-jet recording apparatus in the second embodiment is that an interval for determining the drive voltage is a short time interval when the recording for a first sheet of the recording paper is performed, and an interval for determining the drive voltage is a long time interval when the recording for a second and subsequent sheets of the recording paper is performed. Since the ink-jet recording apparatus of the second embodiment has the same structure as the ink-jet recording apparatus 1 according to the first embodiment, and the same process are executed by the microcomputer as those in the first embodiment except for a part of the process, the explanation of the same parts, components and process as those in the first embodiment is either simplified or omitted, and the same reference numerals are used for the same parts, components and process as those in the first embodiment.

When the initial setting is performed (S2 in FIG. 6), the microcomputer 70 puts ON a recording initial flag indicating that it is a recording of the first sheet of the recording paper immediately after the power supply is turned "ON" (S3). Next, a judgment is made as to whether or not recording data to be recorded is available or ready (S4). When it is judged that the recording data to be recorded is available (S4: Yes), the microcomputer 70 detects a head temperature T1 based on a detection signal from the temperature sensor 88 (S5); the microcomputer 70 refers to the Table 74*a* (S6); and reads, from the Table 74*a*, a drive voltage associated with the head temperature detected in S5. Next, the microcomputer 70 determines the voltage, which has been read from the Table 74*a*, to be the drive voltage V1 to be used for performing the first recording (S7).

Next, the microcomputer 70 starts the recording at the drive voltage V1 determined at S7 (S8), and makes a judgment as to whether or not a recording of one scanning is completed (S9). Here, when a judgment is made that the recording of one scanning is completed (S9: Yes), then "1" is added to the scanning number "n" which is a number for which the scanning has been completed (S10), and a judgment is made as to whether or not the recording initial flag is ON in S3 (S11). In other words, a judgment is made as to whether or not the recording to be performed from now onward is a recording of the first sheet of the recording paper, immediately after the power supply is turned "ON". Here, when it is judged that the recording initial flag has been ON (S11: Yes), a judgment is made as to whether or not the scanning number "n" has reached "m1" (S12). On the other hand, when it is judged that the recording initial flag has not been ON (S11: No), a judgment is made as to whether or not the scanning number "n" has reached "m2" (S13). Here, "m1" and "m2" are any integer numbers, and m1<m2. For example, "m1" and "m2" may be m1=5 and m2=10.

Here, when it is judged that the scanning number "n" has reached "m1" in S12 (S12: Yes), or when it is judged that the scanning number "n" has reached "m2" in S13 (S13: Yes), then the microcomputer 70 detects a head temperature T2 (S14 in FIG. 7). Then, the microcomputer 70 refers to the Table 74*a* (S15), and reads from the Table 74*a* the drive voltage associated with the head temperature T2 detected at step S14. Next, the microcomputer 70 determines temporarily the drive voltage read from the Table 74*a* to be the drive voltage V2 to be used for performing the recording this time (S16). In other words, since m1<m2, an interval (first time interval) for determining the drive voltage becomes short in a period of time during which the recording is performed on the first sheet of the recording paper immediately after the power supply has been turned "ON"; and an interval (second time interval) becomes long in a period of time during which the recording is performed on the second and subsequent sheets of the recording paper. Next, a correction is made to the drive voltage V2 determined temporarily (steps from S18 to S21) in a similar manner as in steps from S15 to S18 of the first embodiment.

Next, a judgment is made as to whether or not the recording of the first recording paper has been completed (S22), and when it is judged that the recording of the first sheet of the recording paper has been completed (S22: Yes), the recording initial flag is turned OFF (S23). Thus, when the recording initial flag is once turned OFF, in a subsequent cycle, a negative judgment is made every time S11 is performed. Accordingly, a judgment is made as to whether or not the scanning number "n" has reached "m2". In other words, in the recording of the second and subsequent sheets of the recording paper, the interval for determining the drive voltage becomes longer than the interval for determining the drive voltage in case of the first sheet of the recording paper.

As described above, when the ink-jet recording apparatus 1 of the second embodiment is used, in a period of time during which the head temperature is very likely to rise as the recording time is increased or prolonged, as in a case of performing the recording on the first page of the recording paper immediately after the power supply is put ON, it is possible to use the optimum drive voltage corresponding to the temperature of the ink by shortening the interval for determining the drive voltage. Therefore, it is possible to improve the recording quality. Further, in a period of time during which the rise in the head temperature is either gradual or about to be stalled, as in a case of performing the recording on the second and subsequent sheets of the recording paper, it is possible to decrease a number of processes performed for determining the drive voltage, by making the interval for determining the drive voltage to be longer. Therefore, it is possible to reduce a load on the microcomputer 70, by the reduced number of process to be performed.

The ink-jet recording apparatus according to the second embodiment has the same structure and functions, as those of the ink-jet recording apparatus 1 according to the first embodiment, except that the interval for determining the drive voltage is changed between at a time when the recording is performed on the first sheet of the recording paper immediately after the power supply is put ON, and at a time when the recording is performed on the second and subsequent sheets of the recording paper. Therefore, it is possible to obtain also the above-mentioned effects of the first embodiment.

Other Embodiment

In the first embodiment and the second embodiment, when the absolute value of the difference between the drive voltage V1 used previous time and the drive voltage V2 which is intended to be used this time is greater than ΔV, then the drive voltage, which is obtained by making a correction, by only ΔV, to the drive voltage V1 of the previous time, is determined to be the drive voltage V2 to be used this time. However, other than ΔV, it is also allowable to set a value smaller than ΔV as a correction value. In this case also, it is possible to obtain effects same as those in the first embodiment and the second embodiment.

The head temperature and the drive voltage have a relationship such that when there is a rise in the head temperature (ink temperature), the drive voltage decreases; and when there is a fall in the head temperature, the drive voltage increases. Therefore, it is possible to determine the drive voltage V2 to be used this time, based on a result of a judgment of whether or not the absolute value of the difference between the head temperature detected previous time and the head temperature detected this time is greater than a value (degrees) of Δ For example, when the difference is not more than Δ degrees, then the drive voltage V2' temporarily determined is determined to be the drive voltage V2 to be used this time, based on the temperature detected this time. On the other hand, when the difference is higher than Δ degrees, then a drive voltage which is made to be close (approximated), from the drive voltage V1 determined previous time, to the drive voltage V2' determined temporarily this time, by only a value smaller than the difference between the drive voltage V1 determined based on the temperature detected previous time and the drive voltage V2 determined temporarily based on the temperature detected this time, is determined to be the drive voltage V2 to be used this time. In this case also, it is possible to obtain effects same as those in the first embodiment and the second embodiment.

In the first embodiment and the second embodiment, the timing for detecting the head temperature is determined based on the scanning number of the ink-jet head. However, it is also allowable to determine the timing based on the recording time. For example, the head temperature may be detected when it is judged that the recording time has reached a predetermined time. In this case, by setting the predetermined time to be shorter than the recording time interval at which the printing on one page is performed, it is possible to adjust the drive voltage to the change in the temperature of ink during the printing on the first page.

Figure 11A:
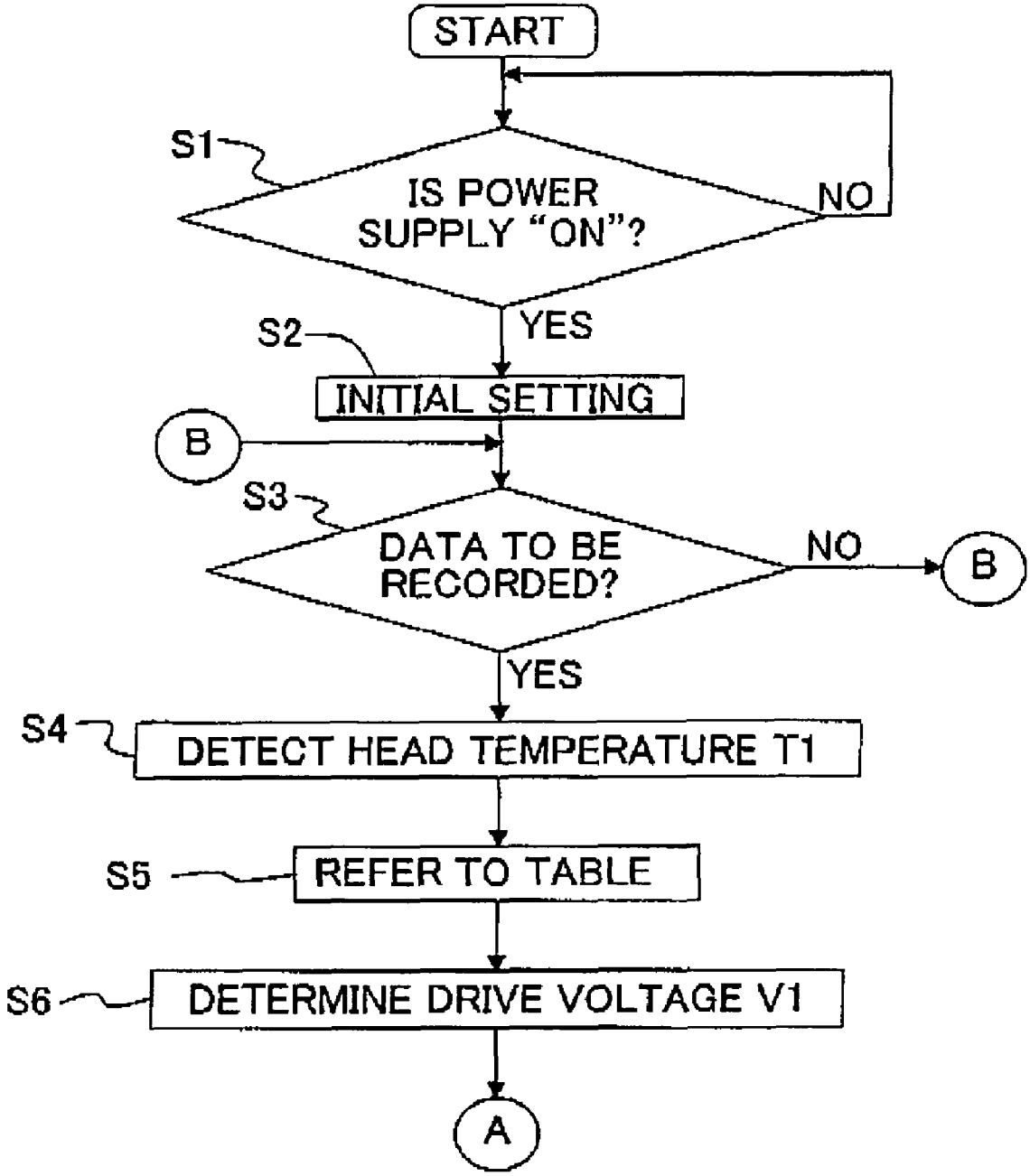
FIG. 11A is a flow chart showing a flow of a process executed by the microcomputer 70 for determining the drive voltage in another embodiment.
Figure 11B:
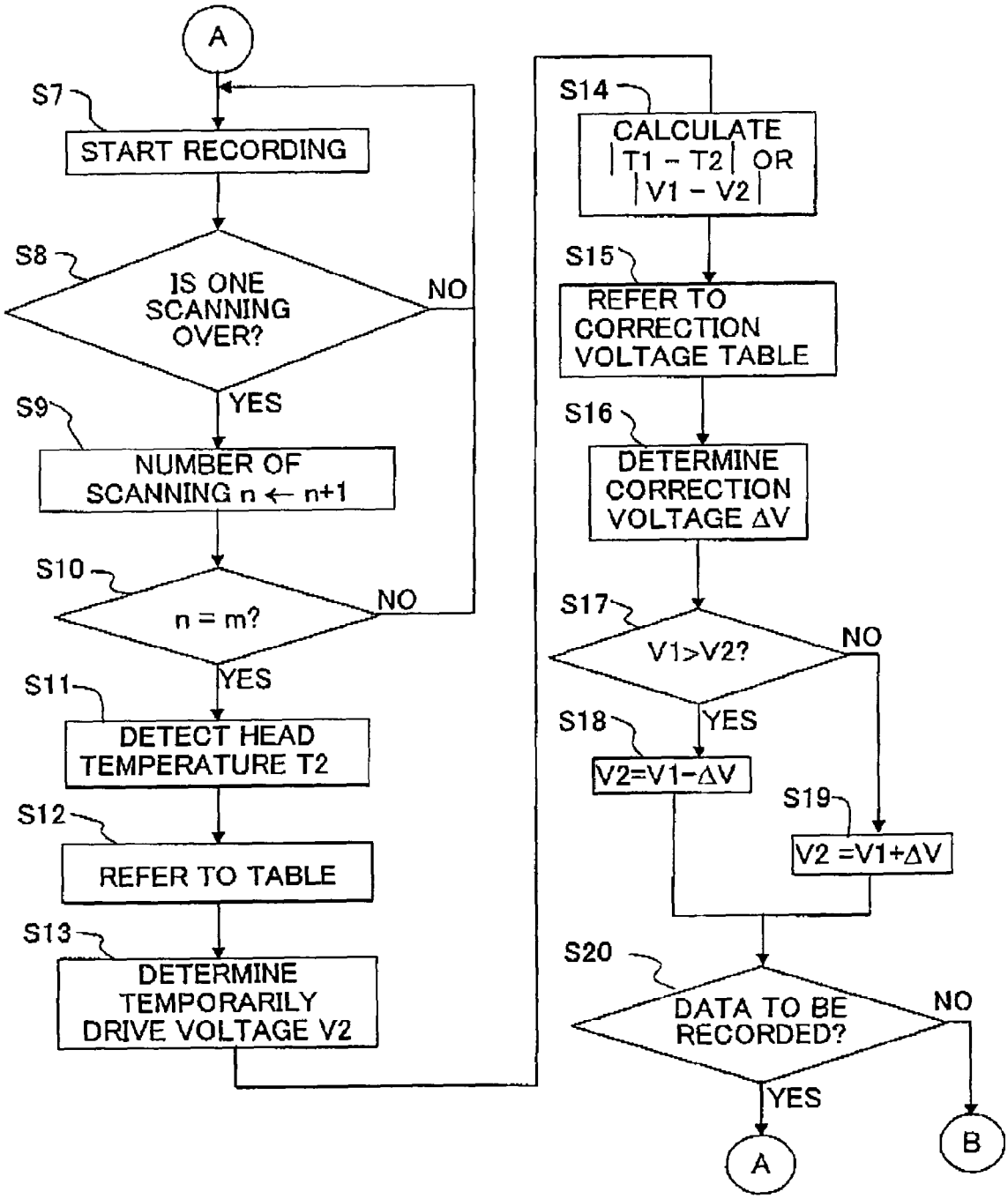
FIG. 11B is a flowchart showing the process continued from FIG. 11A.

The embodiments are provided with Table 74*a* in which different drive voltage are associated with different ranges of the head temperatures, respectively. However, the present invention is not limited to such a Table 74*a*. For example, it is allowable to provide a correction voltage table in which correction voltages (voltage-correction values) showing correction values to the drive voltage are set corresponding to the differences between the ink temperature at the first timing and at the second timing respectively, or corresponding to the differences between the drive voltage determined at the first timing and a drive voltage determined temporarily at the second timing, respectively. When the absolute value of the difference in the ink temperature is greater than the predetermined value (|T1−T2|>8) as shown in Correction Voltage Table 74*b* in FIG. 9, or when the absolute value of the difference in the drive voltage is greater than the predetermined value (|V1−V2|>2) as shown in Correction Voltage Table 74*c* in FIG. 10, then the correction voltage may be a constant value (ΔV=2.0). Next, a flow of a process which the microcomputer 70, provided in the ink-jet recording apparatus of the present invention, executes for determining the drive voltage at the second timing will be explained briefly with reference to a flowchart shown in FIGS. 11A and 11B. In FIGS. 11A and 11B, since each of steps from the start to S13 is similar to each of the step from the start to S13, respectively, in FIGS. 4A and 4B, the description of these steps is omitted. In FIGS. 11A and 11B, after the drive voltage V2 is determined temporarily in S13, the absolute value of the difference between the ink temperature detected at the first timing and the ink temperature detected at the second timing, or the absolute value of the difference between the drive voltage determined at first timing and the drive voltage determined temporarily at the second timing is calculated or obtained (S14). Next, by referring to the Correction Voltage Table 74*b* or 74*c* (S15), a value of ΔV corresponding to the difference calculated in S14 is determined as a correction voltage (S16). Next, a judgment is made as to whether or not the drive voltage V1 determined in S6 is greater than the drive voltage determined temporarily in S13 (S17). When it is judged that V1 is greater than V2 (S17: Yes), then a drive voltage, which is obtained by subtracting the correction voltage ΔV determined in S16 from the drive voltage V1 determined in S6, is determined to be the drive voltage V2 at the second timing (S18). On the other hand, when it is judged that the drive voltage V1 determined in S6 is not more than the drive voltage V2 determined temporarily in S13 (S17: No), then a drive voltage, which is obtained by adding the correction voltage ΔV determined in S16 to the drive voltage V1 determined in S6, is determined to be drive voltage V2 at the second timing (S19). Thus, when determining the drive voltage at the second timing, the correction voltage ΔV corresponding to the absolute value of the difference between the ink temperatures or the absolute value of the difference between the drive voltages may be read from the Correction Voltage Table 74*b* or 74*c*, and the drive voltage at the second timing may be determined by making a correction, by only ΔV, to the drive voltage at the first timing. By determining the drive voltage at the second timing in such manner, similarly as in the embodiments described above, it is possible to maintain satisfactory recording quality in which any sudden change in the drive voltage does not occur even when the temperature of the ink is changed suddenly. By replacing steps from S14 to S20 in this embodiment by steps from S17 to S21 in the second embodiment, the steps from S14 to S20 in this embodiment can be applied also to the second embodiment.

In the embodiments, the microcomputer 70 refers to Table 74*a* and sets the drive voltage corresponding to the temperature detected by the temperature sensor 88. However, the present invention is not limited to them. For example, a calculation formula, for calculating the drive voltage from the temperature detected by the temperature sensor 88, may be stored in advance in the microcomputer 70. Every time the temperature sensor 80 detects the temperature, the microcomputer 70 may calculate and determine the drive voltage from the temperature detected by the temperature sensor 88, based on the calculation formula. By doing so, there is no need to prepare Table 74*a* in advance, and the ROM 74 can be used efficiently.

In the embodiment, the temperature of the ink-jet head detected by the temperature sensor 88 is considered to be the temperature of ink. However, the temperature sensor 88 may be provided inside the ink cartridges 25 to 28, in the ink channels of the ink heads 21 to 24, or inside ink channels each from one of the ink cartridges to the ink-jet head, and temperature of the ink in each of the ink cartridges and in each of the ink channels may be measured directly by the temperature sensor 88. In this case, for the purpose of measuring the ink temperature as close as possible to the ink temperature at the time of jetting, it is desirable that the temperature sensor 88 is provided at a position in the vicinity of the nozzle disposed in each of the ink channels.

In these embodiments, when the absolute value |T1−T2| of the difference between the ink temperature T1 detected at the first timing and the ink temperature T2 detected at the second timing, or the absolute value |V1−V2| of the difference between the drive voltage at the first timing determined based on the ink temperature T1 detected at the first timing and the drive voltage V2 temporarily determined (set) based on the ink temperature detected at the second timing is not greater than the predetermined value, then the drive voltage V2 determined temporarily is determined to be the drive voltage at the second timing. However, the present invention is not limited to them. For example, in S14 in FIG. 4, when |T1−T2| is not more than the predetermined value ΔT, or when |V1−V2| is not more than the predetermined value ΔV, then the drive voltage V1 at the first timing as it is may be determined in S18 as the drive voltage at the second timing, rather than the drive voltage V2 temporarily set as described above. In this case, when |T1−T2| is greater than the predetermined value or when |V1−V2| is greater than the predetermined value, then the drive voltage at the second timing may be determined similarly as in the embodiments. According to this embodiment, when the difference is not more than the predetermined value, namely, when the change in the temperature of the ink is within a predetermined range, the drive voltage is maintained to be constant. On the other hand, only when the difference is greater than the predetermined value, in other words, only when the temperature of the ink is changed suddenly, a correction is made to the drive voltage which has been maintained to be constant, only by a value corresponding to the predetermined value. Consequently, since it is not necessary to change the drive voltage when the change in the ink temperature is small, the control of the drive voltage becomes easy. Further, even when the ink temperature is changed suddenly, the drive voltage is not changed suddenly, thereby making it possible to maintain a satisfactory recording quality.

What is claimed is:

1. An ink-jet recording apparatus which includes an ink-jet head and performs recording by discharging an ink onto a recording-objective medium by driving an actuator, the apparatus comprising:

a temperature sensor which detects a temperature of the ink;

a drive voltage-determining section which determines a drive voltage amplitude for driving the actuator, according to the temperature of the ink detected by the temperature sensor, and which determines a new drive voltage amplitude when the temperature of the ink is changed; and a driving section which drives the actuator by one of the drive voltage amplitude and the new drive voltage amplitude determined by the drive voltage-determining section;

wherein the drive voltage-determining section calculates one of a difference between a first temperature detected at a first timing and a second temperature detected at a second timing and a difference between a first drive voltage amplitude at the first timing determined based on the first temperature and a temporary drive voltage amplitude set based on the second temperature, and the drive voltage-determining section determines a second drive voltage amplitude at the second timing which directly corresponds to the calculated difference;

wherein when the difference is not more than a predetermined value, the drive voltage-determining section determines the temporary drive voltage amplitude to be the second drive voltage amplitude at the second timing; and when the difference is greater than the predetermined value, the drive voltage-determining section determines a drive voltage amplitude, which is made to be close, from the first drive voltage amplitude at the first timing, to the temporary drive voltage amplitude by only a value smaller than a difference voltage between the first drive voltage amplitude at the first timing and the temporary drive voltage amplitude, to be the second drive voltage amplitude at the second timing.

2. The ink-jet recording apparatus according to claim 1;

wherein the drive voltage-determining section determines the second drive voltage amplitude at the second timing, at every first time interval, during a predetermined period of time from a start of recording; and when the predetermined period of time is elapsed, the drive voltage-determining section determines the second drive voltage amplitude at the second timing at every second time interval which is longer than the first time interval.

3. The ink-jet recording apparatus according to claim 1, further comprising:

a table in which drive voltage amplitudes are set for a plurality of temperature ranges, respectively.

4. The ink-jet recording apparatus according to claim 3;

wherein when the difference is greater than a predetermined value, the drive voltage-determining section reads, from the table, a drive voltage amplitude between the first drive voltage amplitude at the first timing and the temporary drive voltage amplitude, and determines the read voltage to be the second drive voltage amplitude at the second timing.

5. The ink-jet recording apparatus according to claim 1;

wherein the drive voltage-determining section determines the second drive voltage amplitude at the second timing every time a scanning of the recording-objective medium is performed by the ink-jet head for a predetermined number of times.

6. The ink-jet recording apparatus according to claim 1;

wherein an interval between the first timing and the second timing is shorter than a recording time for one piece of the recording-objective medium.

7. The ink-jet recording apparatus according to claim 1;

wherein the temperature sensor is provided on the ink-jet head; and the temperature of the ink is obtained by detecting a temperature of the ink-jet head.

8. An ink-jet recording apparatus which includes an ink-jet head and performs recording by discharging an ink onto a recording-objective medium by driving an actuator, the apparatus comprising:

a temperature sensor which detects a temperature of the ink;

a drive voltage-determining section which determines a drive voltage amplitude for driving the actuator, according to the temperature of the ink detected by the temperature sensor, and which determines a new drive voltage amplitude when the temperature of the ink is changed; and a driving section which drives the actuator by one of the drive voltage amplitude and the new drive voltage amplitude determined by the drive voltage-determining section;

wherein the drive voltage-determining section calculates one of a difference between a first temperature detected at a first timing and a second temperature detected at a second timing and a difference between a first drive voltage amplitude at the first timing determined based on the first temperature and a temporary drive voltage amplitude set based on the second temperature, and the drive voltage-determining section determines a second drive voltage amplitude at the second timing which directly corresponds to the calculated difference; and wherein when the difference is greater than a predetermined value, the drive voltage-determining section determines a drive voltage amplitude, which is obtained by correcting the first drive voltage amplitude at the first timing only by a correction amount corresponding to the predetermined value, to be the second drive voltage amplitude at the second timing.

9. A recording method for using an ink-jet head which performs recording by discharging an ink onto a recording-objective medium by driving an actuator, the method comprising:

detecting a first temperature of the ink at a first timing;

determining a first drive voltage amplitude at the first timing based on the first temperature of the ink at the first timing;

detecting a second temperature of the ink at a second timing;

setting a temporary drive voltage amplitude based on the second temperature of the ink at the second timing;

calculating one of a difference between the first temperature of the ink detected at the first timing and the second temperature of the ink detected at the second timing and a difference between the first drive voltage amplitude at the first timing determined based on the first temperature and the temporary drive voltage amplitude set based on the second temperature;

determining a second drive voltage amplitude at the second timing which directly corresponds to the calculated difference; and performing the recording by discharging the ink onto the recording-objective medium by driving the actuator by the second drive voltage amplitude at the second timing which has been determined;

wherein when the difference is not more than a predetermined value, the temporary drive voltage amplitude is determined to be the second drive voltage amplitude at the second timing; and when the difference is greater than the predetermined value, a drive voltage amplitude, which is made to be close, from the first drive voltage amplitude at the first timing, to the temporary drive voltage amplitude by only a value smaller than a difference voltage between the first drive voltage amplitude at the first timing and the temporary drive voltage amplitude, is determined to be the second drive voltage amplitude at the second timing.

10. The recording method according claim 9;

wherein the second drive voltage amplitude at the second timing is determined, at every first time interval, during a predetermined period of time from a start of recording; and when the predetermined period of time is elapsed, the second drive voltage amplitude at the second timing is determined at every second time interval which is longer than the first time interval.

11. The recording method according to claim 9;

wherein the second drive voltage amplitude at the second timing is determined every time a scanning of the recording-objective medium is performed by the ink-jet head for a predetermined number of times.

12. The recording method according to claim 9;

wherein an interval between the first timing and the second timing is shorter than a recording time for one piece of the recording-objective medium.

13. The recording method according to claim 9;

wherein a temperature of the ink is a temperature of the ink in the ink-jet head; and wherein the temperature of the ink is obtained by detecting a temperature of the ink-jet head.

14. A recording method for using an ink-jet head which performs recording by discharging an ink onto a recording-objective medium by driving an actuator, the method comprising:

detecting a first temperature of the ink at a first timing;

determining a first drive voltage amplitude at the first timing based on the first temperature of the ink at the first timing;

detecting a second temperature of the ink at a second timing;

setting a temporary drive voltage amplitude based on the second temperature of the ink at the second timing;

calculating one of a difference between the first temperature of the ink detected at the first timing and the second temperature of the ink detected at the second timing and a difference between the first drive voltage amplitude at the first timing determined based on the first temperature and the temporary drive voltage amplitude set based on the second temperature;

determining a second drive voltage amplitude at the second timing which directly corresponds to the calculated difference; and performing the recording by discharging the ink onto the recording-objective medium by driving the actuator by the second drive voltage amplitude at the second timing which has been determined; and wherein when the difference is greater than a predetermined value, a drive voltage amplitude, which is obtained by correcting the first drive voltage amplitude at the first timing only by a correction amount corresponding to the predetermined value, is determined to be the second drive voltage amplitude at the second timing.

15. A recording method for using an ink-jet head which performs recording by discharging an ink onto a recording-objective medium by driving an actuator, the method comprising:

detecting a first temperature of the ink at a first timing;

determining a first drive voltage amplitude at the first timing based on the first temperature of the ink at the first timing;

detecting a second temperature of the ink at a second timing;

setting a temporary drive voltage amplitude based on the second temperature of the ink at the second timing;

calculating one of a difference between the first temperature of the ink detected at the first timing and the second temperature of the ink detected at the second timing and a difference between the first drive voltage amplitude at the first timing determined based on the first temperature and the temporary drive voltage amplitude set based on the second temperature;

determining a second drive voltage amplitude at the second timing which directly corresponds to the calculated difference; and performing the recording by discharging the ink onto the recording-objective medium by driving the actuator by the second drive voltage amplitude at the second timing which has been determined;

wherein the second drive voltage amplitude at the second timing is determined by referring to a table in which drive voltage amplitudes are set for a plurality of temperature ranges, respectively; and wherein when the difference is greater than a predetermined value, a drive voltage amplitude between the first drive voltage amplitude at the first timing and the temporary drive voltage amplitude is read from the table, and the read drive voltage amplitude is determined to be the second drive voltage amplitude at the second timing.

* * * * *